United States Patent [19]

Blakeway

[11] Patent Number: 4,625,487

[45] Date of Patent: Dec. 2, 1986

[54] BODY SUPPORT

[75] Inventor: Richard S. Blakeway, Queensland, Australia

[73] Assignee: Francis John Boundy, Victoria, Australia

[21] Appl. No.: 703,511

[22] Filed: Feb. 20, 1985

[30] Foreign Application Priority Data

Feb. 21, 1984 [AU] Australia ..... PG3731

[51] Int. Cl.[4] ..... A61G 7/10

[52] U.S. Cl. ..... 5/446; 5/60; 5/109; 128/33; 128/52

[58] Field of Search ..... 5/60, 61, 101, 108, 5/109, 446, 447; 128/33, 52, 70–74; 269/324–326

[56] References Cited

U.S. PATENT DOCUMENTS

| | | | |
|---|---|---|---|
| 171,900 | 1/1876 | Wilson et al. | 5/109 |
| 2,381,922 | 8/1945 | Norris | 128/73 |
| 2,634,975 | 4/1953 | Hahs | 128/33 |
| 2,910,060 | 10/1959 | Werner et al. | 128/33 |
| 3,790,150 | 2/1974 | Lippert | 5/351 |
| 3,851,430 | 12/1974 | Schuster | 52/108 |
| 3,882,556 | 5/1975 | Accurso | 5/109 |
| 4,222,137 | 9/1980 | Usami | 5/446 |
| 4,267,610 | 5/1981 | Blakeway | 5/60 |
| 4,494,260 | 1/1985 | Olds et al. | 5/446 |
| 4,559,656 | 12/1985 | Foster | 5/236 R |

FOREIGN PATENT DOCUMENTS

| | | | |
|---|---|---|---|
| 984552 | 3/1976 | Canada | 5/60 R |
| 91747 | 3/1958 | Norway | 269/325 |
| 943834 | 12/1963 | United Kingdom . | |
| 1009787 | 11/1965 | United Kingdom . | |
| 1385249 | 2/1975 | United Kingdom . | |
| 2077580A | 12/1981 | United Kingdom | 5/60 |

*Primary Examiner*—John E. Murtagh
*Assistant Examiner*—Andrew Joseph Rudy
*Attorney, Agent, or Firm*—Karen M. Gerken; Martin P. Hoffman; Mitchell B. Wasson

[57] ABSTRACT

A body support for immobile persons comprising a series of parallel, elongate resilient cushions, with adjacent cushions tilted in opposite directions to vary the areas of support provided to a person thereon to prevent development of bed sores and other related problems. The tilting cushions, in moving in alternate directions, in addition to shifting lift from one cushion edge to the other, reciprocatively approach and move away from their neighbours in a movement which provides a massaging effect.

7 Claims, 4 Drawing Figures

BODY SUPPORT

This invention relates to an improved body support and more particularly to a body support effective in the prevention of thrombosis.

There is a continuing need for body supports designed to prevent the development of bed sores and thrombosis. One form of known body support comprises a mattress structure formed of flexible gas filled compartments which are inflated and deflated in an ordered sequence. The rippling effect produced in this type of body support continuously moves the points of support so as to enable blood flow to tissues which would otherwise be continuously pressed under the weight of an immobile patient, starved for nutrient and oxygen, to degenerate and become the site of bed sores. Trapped pockets of blood may be caused to clot and create a risk of thrombosis. The changing contact area of the body support obviates these effects.

Another known type of hospital bed includes a series of parallel horizontal resiliently yieldable rollers located between and in contact with a top sheet tensioned above a frame, and a plate which is reciprocal longitudinally with respect to the bed and is moved back and forth by a drive mechanism so that the rollers are fairly slowly advanced and retracted to roll in one direction and the other under the sheet. The soft rollers form a comfortable support for a patient lying on the bed and, because of their motion under the fixed sheet, the pressure points on supported parts of the body of the patient are reciprocatively shifted to produce a gentle massaging effect. Beds of this type have been found to be highly conducive to the comfort of patients who are immobilised. This system is applicable to other body supports also, such as seats of various kinds and operating tables.

A later prior art development was a rectangular block bed. Instead of rollers, rectangular blocks are employed, each supported on pivots to enable a rolling movement, and each moved in unison so as to roll beneath a body supported thereon. The rise and fall of each block corner creates the required shifting support areas. However, the rolling of the rectangular blocks imposes a number of undesirable penalties. To roll the blocks requires some spacing between the blocks as the ultimate angle of tilt, is limited by the size of the gap and the dimensions of the block. In the process of rolling the blocks, whilst the body thereon is subjected to a shifting support, the rolling of the blocks results in a perceptible reciprocation along the length of the bed. The spaced nature of the blocks allows air currents to circulate between. Narrowing the space limits the tilt of the blocks and this means insufficient contrast between the high and low pressure areas such that relief attained may be inadequate.

Similar arrangements are shown in U.K. Pat. Nos. 943,834 and 1,009,787, each with similar disadvantages to those of the block bed above.

An object of the present invention is an improved varying contact pressure body support which greatly enhances the action of such beds in preventing the development of bed sores and thrombosis. It is a further object of the invention to provide a body support means which is able to provide a variable contact surface with an effective contrast between its high and low pressure points so that a body thereon is properly supported and gently massaged to keep body tissues supplied with blood and adequately oxygenated. It is a still further object of the present invention to provide a body support capable of providing the necessary surface effect without causing a reciprocative displacement of a body thereon whilst performing its stimulating and massaging effect in a novel and hitherto unrealised manner. Another object of the present invention is the provision of a support body which is able to be reliably operated in any environment such as hospitals, nursing homes, homes, etc. An additional object of the present invention is the production of a body support which retains all the simple and inexpensive constructional features of the prior art tilting block beds. Other objects and advantages of the present invention will hereinafter become apparent.

The present invention achieves its objects by provision of a body support comprising a flat topped support surface built up of series of parallel, elongated, side by side, support means, each said support means being pivotally mounted for rotational movement about an axis transverse to one dimension of said body support, each said support means being provided with an upper support surface each generally in the same plane as its neighbours when said support means are disposed with their upper surfaces parallel to said support surface, each said support means being supported for tilting about its rotational axis, each said support means being so shaped that in their horizontal situation each support means substantially abuts against its neighbour and can be tilted from the horizontal without fouling against its neighbours, drive means being provided, operatively linked to a pair of drive links moved thereby reciprocatively in a direction transverse to the support means axes, and each drive link being connected to alternate support trays along the series of trays so as to move them as two interconnected groups, each group moving in opposed manner to the other.

In order that the invention may be more readily understood and put into practical effect, reference will now be made to the accompanying drawings which illustrate a preferred embodiment thereof and wherein.

Figure 3A:
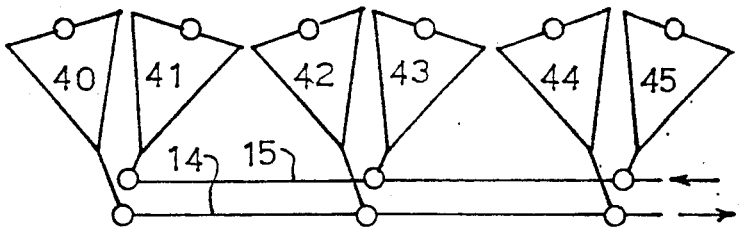
Figure 3B:
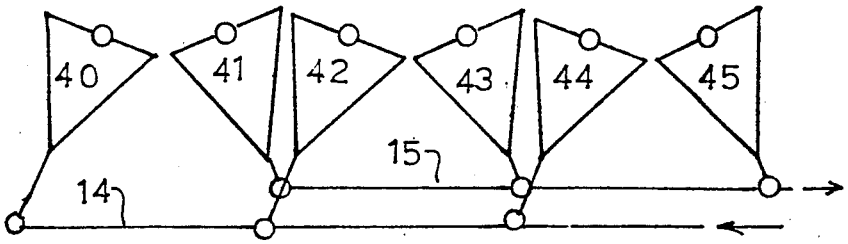
Figure 4:
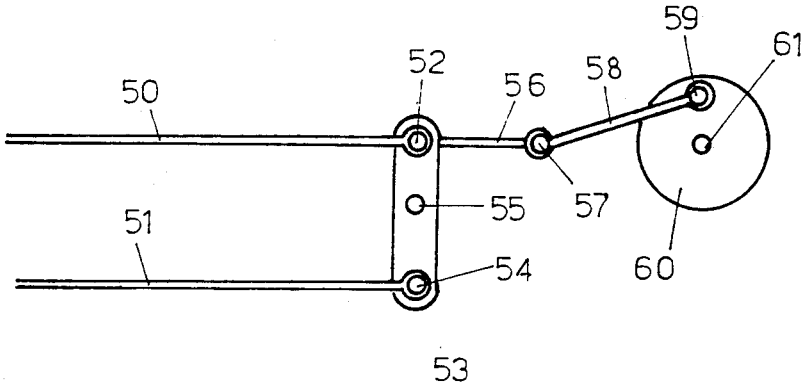

FIGS. 3*a* and 3*b* illustrate the surface contours achieved by the body support in use; and FIG. 4 shows an alternate drive mechanism.

Figure 1:
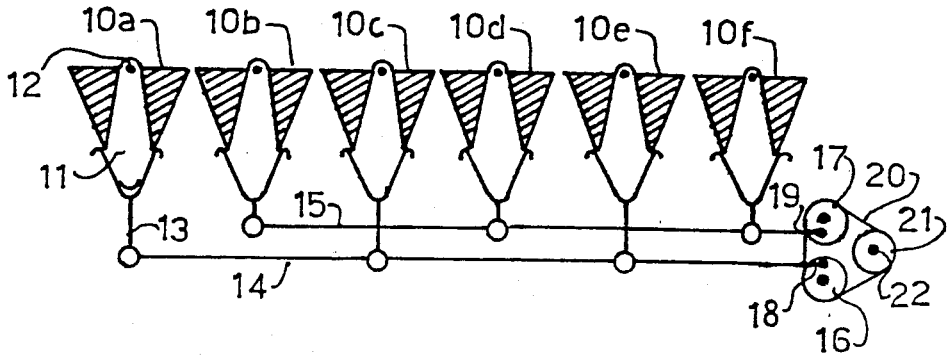
FIG. 1 is a side view of a body support according to the present invention.

In FIG. 1 the body support comprises a series of blocks 10*a* to 10*f* mounted abutting one to another to create a support surface made up of the adjoining upper surfaces of each block. In use the blocks extend transverse to say the length of a bed and typically 10 to 15 blocks are arranged in series, edge to edge down the length of a bed. Flat upper surfaces of the blocks may provide the body support surface and the block edges extend across a body reclining thereon to support the body as is described below.

The blocks 10*a* to 10*f* of FIG. 1 are typically formed of a resilient material with a certain amount of give to enable a comfortable support surface with a relatively, thin continuous covering surface thereover to provide a mattress like upper surface bridging over the series of transverse blocks. Materials for such blocks include common polyurethane foams. The blocks of material provide a cushioned surface whilst generating the requisite action as distinct from some of the prior beds where a separate mattress structure must be provided. The operation of beds such as that of U.K. Pat. No.

1,009,787 is improved by the adoption of the present method of operation.

Polyurethane foam is readily available and easily cut to shape and lends itself to impervious covering for hygenic application in hospital situations. The foam provides a useful material for a support surface having sufficient give to be comfortable beneath a body being moved about and yet providing sufficient upward pressure as described below in producing the massaging effect of the invention.

The blocks of FIG. 1 are supported each upon a respective support tray shown as 11. Each tray 11 is supported for pivotal movement about an axis 12 and in order to enable this action the tray 11 is connected via a suitable flexible joint at 13 to a reciprocating rod 14. Alternate trays are connected to rod 14 so that blocks 10*a*, 10*c* and 10*e* may be moved as a unit. The remaining trays are similarly connected to reciprocating rod 15 to enable the alternate blocks 10*b*, 10*d* and 10*f* to be moved as a unit. More detail of the movement of the blocks is given below but in order that one set of blocks rotates one way, as the other rotates the other, the two reciprocating rods 14 and 15 need only be connected eccentrically at 18 and 19 to two sprocket wheels 16 and 17 mounted for rotation by a chain drive 20 off sprocket 21 driven on its axle 22 by a motor not shown. The drive may be conveniently located beneath the bed and obviously its disposition is largely a matter of choice. A man skilled in the art will have no difficulty conceiving different forms and layouts of drives effective to move the blocks in the desired manner set out below.

Figure 2:
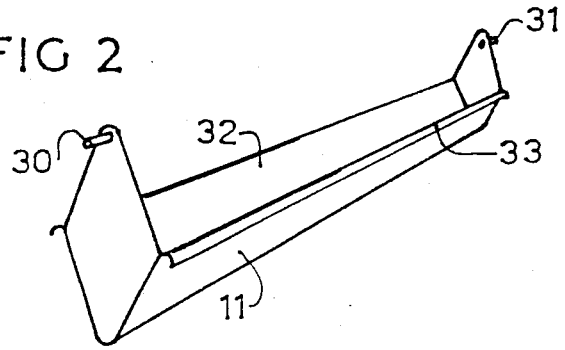
FIG. 2 is a perspective view of a block support tray as might be used in a body support as in FIG. 1.

FIG. 2 shows a tray suitable for supporting the blocks of FIG. 1. Tray 11 is provided with pivots 30 and 31 for lodgment in suitable journals to enable a rocking movement of the tray. It will be clear that any means of pivotally supporting the tray is within the scope of the invention. Tray 11 is shown with a triangular cross-section so as to support a triangular block of material to provide the support surface. Triangular shaping enables the tilting of the blocks without the sides engaging against neighbouring blocks as occurs with rectangular blocks to prevent tilting when the blocks butt up against one another. Triangular shapes enable production of a body support wherein the support surface is free of gaps when all the blocks are disposed horizontal and yet allows for rotations.

In constructing tray 11, sheet metal techniques may be employed, and to remove the sharp edge arising at the tray top, the edge need only be rolled over as shown at 33. An advantage arises out of this structure in that the rolled edge 33 provides stiffening against torsional forces.

When triangles are employed for the blocks, the degree of tilt is determined by the slope of the side surfaces such that triangles with little depth are able to tip furtherest. However some depth of resilient material is required for comfort and a practical trade off must be made between depth of material for comfort and angle of tilt. As the object of the invention is a shifting pressure point, the edges of the blocks need only lift far enough for that purpose so that an extreme tilt is not really required. Consequently, considerable depth is obtainable resulting in good leverage and little work to be done by the power source.

Shapes other than triangular might be employed for the support blocks and clearly hemispherical blocks would serve the basic object of enabling an abutting block bed. However the support of such a block requires a more elaborate means than a hemispherical tray as such a device does not lock the block against the pressure of an upward movement and the block is likely to slip in the tray. The blocks might be adhered to the trays by a suitable glue but that may not be suitable in applications where the blocks need be removed for cleaning. The triangular tray simply supports and locks the blocks in place during operation. That shape also enables simple cutting with minimised waste when cut from slab material.

FIGS. 3*a* and 3*b* show the action of the bed in side view. The blocks of FIGS. 3*a* and 3*b* are supported in respective trays, connected by flexible links to reciprocating links 14 and 15 as is described above. The blocks are interconnected in two groups one group connected each to one of the two reciprocating links 14 and 15. Links 14 and 15 are powered to move in opposite direction relative one to the other so that whilst link 14 moves to the left link 15 moves to the right. As the links move they tilt their respective groups of blocks and the effect is as seen in FIGS. 3*a* and 3*b*. Blocks 40 and 41 first rotate their abutting edges upwards to form a peak beneath a body supported thereon and then fall to form a valley. This vertical oscillation provides a varying support pressure. The opposite rotations in effect cancel any displacement of the body as occurs with prior body supports where all the blocks moved one way. In this invention the horizontal components of motion cancel over the total body length but at the areas of the individual blocks a slight stretching and compressing occurs to more effectively massage the body as adjoining blocks rotate towards and away from each other. With the blocks coupled in two groups, they act as oppositely moving pairs over the whole length of the body support.

A body support of the above type might be constructed as a mattress-like body support for location on an existing bed or be built as an integral part of a bed with tilt control and removable head and tail boards. The triangular blocks enable their mounting in support frames (not shown in the drawings) which may be straight to provide a flat support surface or curved to provide a contoured support surface having the novel effect over its length. A support frame might be provided which is able to be set in a number of different dispositions from flat to elevated at one end or even concavely or convexly curved so as to provide all the commonly available options provided in standard hospital beds.

FIG. 4 shows a preferred drive mechanism for the support which minimises the chance of the mechanism being the cause of accidents in use. The two linkages 50 and 51 which operate to tilt the various trays are connected at 52 and 53 at opposite ends of a centrally pivoted 55 arm 54 which is reciprocated by linkage arms 56 and 58 with arm 56 moving substantially in the direction of the support surface to transmit the action of a remote drive wheel 60 turning on axle 61 to drive arm 58 fixed eccentrically at 59.

It should be clear from the above that the degree of alternate separation and movement towards each other that is undergone by the block corners, and the massaging effect produced thereby is set by the location of the pivot point of each block. In FIG. 2, if the pivot 30 be lowered for a particular height block, the greater the gap which can be developed between the blocks as the blocks tilt, and the greater the horizontal stretch of the body thereover. To allow for adjustments, it is a simple matter to make the trays with end plates that can selectively accommodate a pivot at a range of heights up the end plate.

The above described concept is equally applicable to beds, seats, couches, etc., to be used by largely immobilised patients who might otherwise suffer detrimental effects from the continued pressures of a supporting surface.

While the above has been given by way of illustrative example, many modifications and variations as would be apparent to persons skilled in the art may be made thereto without departing from the broad scope and ambit of the invention as herein set forth and claimed in the following claims.

I claim:

1. A body support comprising a flat topped support surface built up of a series of parallel, elongated, side by side, support means, each said support means being pivotally mounted for rotational movement about an axis transverse to one dimension of said body support, each said support means being provided with an upper support surface each generally in the same plane as its neighbours when said support means are disposed with their upper surfaces parallel to said support surface, each said support means being supported for tilting about its rotational axis by means of a tiltable support tray, each said support means being so shaped that in their horizontal situation each support means substantially abuts against its neighbour and can be tilted from the horizontal without fouling against its neighbours, drive means being provided, operatively linked to a pair of drive links moved thereby reciprocatively in a direction transverse to the support means axes said drive links being adapted to move in opposite directions relative to one another, and each drive link being connected to alternate support trays along the series of trays so as to move them as two interconnected groups, each group moving in opposed manner to the other.

2. A body support as claimed in claim 1, wherein the support means comprise resilient blocks of cushioning material supported upon a tiltable support tray, the support trays being connected to said drive links.

3. A body support as claimed in claim 2, wherein the resilient blocks have triangular cross-sections each oriented with a flat face positioned upwardly.

4. A body support as claimed in claim 2, wherein the resilient blocks are formed with an impervious, inert, sealed surface.

5. A body support as claimed in claim 2, wherein the tiltable trays are pivoted on pivot means which are vertically adjustable up the height of the tray to enable control of the degree of movement.

6. A body support as claimed in claim 1, wherein said drive links comprise a connecting rod extending the length of the support surfaces provided with pivotal connection means therealong whereat support means are connected to enable tilting.

7. A body support comprising a flat topped support surface built up of a series of parallel, elongated, side by side, support means, each said support means being pivotally mounted for rotational movement about an axis transverse to one dimension of said body support, each said support means being provided with an upper support surface each generally in the same plane as its neighbours when said support means are disposed with their upper surfaces parallel to said support surface, each said support means being supported for tilting about its rotational axis upon a support tray engaging with an underside of said support means, each said support means being so shaped thereunder that in their horizontal situation each support means substantially abuts against its neighbours and be tilted from the horizontal without fouling against its neighbour, drive means being provided, operatively linked to a pair of drive links moved reciprocatively in a direction transverse to the support means axes said drive links being adapted to move in opposite directions relative to one another, and each drive link being connected to alternate support trays along the series of trays so as to move them as two interconnected groups, each group moving in opposed manner to the other.

* * * * *